US007676971B2

(12) United States Patent
White et al.

(10) Patent No.: US 7,676,971 B2
(45) Date of Patent: Mar. 16, 2010

(54) TRADE SHOW MARKETING DISPLAY SYSTEM

(75) Inventors: Mel White, Oregon City, OR (US); Kevin Carty, Portland, OR (US)

(73) Assignee: Classic Exhibits, Inc., Portland, OR (US)

( * ) Notice: Subject to any disclaimer, the term of this patent is extended or adjusted under 35 U.S.C. 154(b) by 0 days.

(21) Appl. No.: 12/035,815

(22) Filed: Feb. 22, 2008

(65) Prior Publication Data

US 2009/0211122 A1 Aug. 27, 2009

(51) Int. Cl.
*G09F 15/00* (2006.01)

(52) U.S. Cl. ..... 40/606.12; 40/606.01; 160/352

(58) Field of Classification Search ..... 40/610, 40/606.12, 606.01; 52/245, 36.1, 36.4, 36.5; 160/135, 451, 452, 351, 352; 211/189, 72; 248/146, 174

See application file for complete search history.

(56) References Cited

U.S. PATENT DOCUMENTS

| | | | | | |
|---|---|---|---|---|---|
| 158,217 | A | * | 12/1874 | Low | 160/351 |
| 1,308,680 | A | | 7/1919 | Price | |
| D108,457 | S | | 2/1938 | Rohde | |
| 2,555,986 | A | | 6/1951 | Miller | |
| D166,795 | S | | 5/1952 | Bright | |
| 2,775,833 | A | | 1/1957 | Wishart | |
| D180,583 | S | | 7/1957 | Craig | |
| 2,815,597 | A | | 12/1957 | Carter | |
| 3,113,392 | A | | 12/1963 | Downing | |
| 3,138,886 | A | * | 6/1964 | Cobb | 40/604 |
| 3,494,405 | A | * | 2/1970 | Bartelmas et al. | 160/24 |
| 3,952,437 | A | | 4/1976 | Mitchell | |
| 5,454,180 | A | | 10/1995 | Volpe | |
| 5,903,992 | A | | 5/1999 | Eisenberg | |
| 6,276,084 | B1 | | 8/2001 | Lanier | |
| 6,298,591 | B1 | | 10/2001 | Healy | |
| D458,463 | S | * | 6/2002 | Citterio | D6/332 |
| D488,935 | S | * | 4/2004 | Quintal | D6/426 |
| D536,553 | S | | 2/2007 | Mendini | |
| 7,188,741 | B1 | * | 3/2007 | Abdi et al. | 211/119.004 |

* cited by examiner

*Primary Examiner*—Cassandra Davis
(74) *Attorney, Agent, or Firm*—Davis Wright Tremaine LLP

(57) ABSTRACT

A display system for trade shows and method for assembly thereof. The display system comprises lower and upper lateral frame members, and a plurality of vertical members adapted to connect releasably at the top and bottom to the lateral frame members. Each vertical member has a lower portion that extends outside a first reference plane, and an upper portion that extends outside said first reference plane in the direction opposite the direction of extension of the lower portion. The system further comprises a plurality of legs connected to respective vertical members and releasable fasteners for attaching a sheet of flexible material to the lower and upper lateral members and at least two vertical elongate members for displaying information. The invention also includes a method for assembling a display as described above without the use of extrinsic tools.

17 Claims, 5 Drawing Sheets

TRADE SHOW MARKETING DISPLAY SYSTEM

RELATED APPLICATIONS

An application for a U.S. Design Patent was filed on Feb. 14, 2008 (application Ser. No. 29/303,703) for the aesthetic features of this invention. That application Ser. No. 29/303,703 is hereby incorporated by reference in its entirety.

FIELD OF THE INVENTION

This invention relates generally to the field of advertising and marketing displays, particularly to transportable display system for use as temporary displays at trade shows, conventions, exhibits, marketing events, and similar venues.

BACKGROUND OF THE INVENTION

All publications herein are incorporated by reference to the same extent as if each individual publication or patent application was specifically and individually indicated to be incorporated by reference. The following description includes information that may be useful in understanding the present invention. It is not an admission that any of the information provided herein is prior art or relevant to the presently claimed invention, or that any publication specifically or implicitly referenced is prior art.

In a trade show or convention setting, it is often the case that the most eye-catching display will garner the most interest among the attendees. To help distinguish their exhibit from exhibits of their competitors and thereby achieve maximum attendee traffic, exhibitors typically desire to use a display system that creates maximum impact and visual appeal. At the same time, exhibitors must often transport their display systems from place to place for various trade shows or other exhibits, and have only minimal labor available to set up and break down the display for each use. It is particularly convenient and advantageous if a display system is constructed such that it can be shipped by a door-to-door express freight service, such as United Parcel Service, Federal Express, and the like. This enables the exhibitor staff to travel without having to carry boxes, crates, or other containers for display material, and no special arrangements are required for shipping the display system to the next venue.

Numerous patents have issued in the United States for advertising and display systems. However, many of them consist of straight sections that interlock to form square or rectangular display surfaces. For example, Downing, U.S. Pat. No. 3,113,392 ("Downing"), discloses a "knock down display" for trade shows and demonstrates several shortcomings common to the prior art.

Downing describes a finished display that is flat in both vertical and horizontal axes, and therefore is not particularly eye-catching. In addition, the display system comprises a multitude of components which must be assembled to create subassemblies, and then these subassemblies must be mounted together to create a large display surface. Finally, the surface of the display forms part of the structure, and each time the message is to be changed, new panels must be constructed and then printed.

Healy, U.S. Pat. No. 6,298,591, discloses a modular sign system that employs a curved display surface that produces greater visual impact. However, the structure itself does not lend itself to large-scale displays incorporating higher order curved surfaces.

Similarly, Lanier, U.S. Pat. No. 6,276,084, discloses a sign adapted to be anchored to the ground for applications such as outdoor real estate advertising, and employs a horizontally-curved surface. In this design, the size of the display is limited to relatively small signs since the panel must be somewhat stiff in order to provide some rigidity to the assembled unit.

Volpe, U.S. Pat. No. 5,454,180, describes a temporary display for advertising soon-to-be-released movies or DVD's where a "life size" cutout of the lead character is often utilized. The display includes an S-curved shape in the horizontal axis, though the vertical axis is not curved. The display is built of one piece, shipped flat and assembled on-site by following fold lines. However, the display is to be constructed of inexpensive paperboard or printed cardstock, providing only enough strength to support itself. It is thus a "one time use" display which would be thrown away after use.

Based on the state of the art, as shown in part by the aforementioned examples, there is a need for a lightweight, easily assembled, visually pleasing display system that can be broken down into components small enough for shipment via express freight delivery services.

BRIEF SUMMARY

The following embodiments and aspects thereof are described and illustrated in conjunction with apparatuses and methods which are meant to be exemplary and illustrative, not limiting in scope.

The present invention includes a display system that comprises lower and upper lateral frame members, and a plurality of vertical members adapted to connect releasably at the top and bottom to the lateral frame members. Each vertical member has a lower portion that extends outside a first reference plane defined by the lower lateral member and the upper lateral member, and an upper portion that extends outside said first reference plane in the direction opposite the direction of extension of the lower portion. The system further comprises a plurality of legs connected to respective vertical members. The legs extend outside the first reference plane in the same direction as the direction of extension of the lower portion of the vertical members so that, when the display system is assembled, it is supported by the lower portion of said vertical members and the legs. The system also comprises releasable fasteners adapted to connect the elongate vertical members to the elongate lateral members. The system further comprises releasable fasteners for attaching a sheet of flexible material to the lower lateral members, the upper lateral members, and at least two vertical elongate members for displaying information.

The invention also includes a method for constructing a display, comprising providing a lower elongate lateral member, an upper elongate lateral member, and a plurality of elongate vertical members. The vertical members are adapted to connect releasably at one end to the lower lateral member and to connect releasably at the opposite end to the upper lateral member. Each vertical member has a lower portion that, when the vertical member is connected to the lateral members, extends outside a first reference plane defined by the lower lateral member and the upper lateral member, and an upper portion that extends outside said first reference plane in the direction opposite the direction of extension of the lower portion.

The method further comprises connecting at least two elongate vertical members to the lower elongate lateral member and the upper elongate lateral member and connecting a leg to at least two respective vertical members so that the legs extend outside the first reference plane in the same direction as the direction of extension of the lower portion of the vertical members. The method further comprises erecting the interconnected elongate lower member, the elongate upper member, and elongate vertical members so that the interconnected assembly is supported by the lower portion of the vertical member and the legs. The method also comprises attaching a sheet of flexible material to the lower elongate lateral member, the upper elongate lateral member, and at least two vertical elongate members for displaying information.

It is to be understood that this summary is provided as a means for generally determining what follows in the drawing and detailed description, and is not intended to limit the scope of the invention. Objects, features and advantages of the invention will be readily understood upon consideration of the following detailed description taken in conjunction with the accompanying drawings.

BRIEF DESCRIPTION OF THE DRAWINGS

Exemplary embodiments are illustrated in the referenced figures. It is intended that the embodiments and figures disclosed herein are to be considered illustrative rather than restrictive.

DETAILED DESCRIPTION OF THE INVENTION

All references cited herein are incorporated by reference in their entirety as though fully set forth. Unless defined otherwise, technical and scientific terms used herein have the same meaning as commonly understood by one of ordinary skill in the art to which this invention belongs.

The present invention is designed to create an eye-catching display surface incorporating a vertical "reverse-curve" in the display surface, preferably a "reversed S-curve." In addition, accessory pieces such as a workstation and a narrower "banner" embodiment utilize similar forms to create a visually stimulating display area.

In all the embodiments disclosed herein, the components can be set up and broken down without the use of extrinsic tools. Preferably, the structure of the system components, for example, the back wall display, the workstation, and the banner, each weighs less than fifty pounds, making it easy to move the finished assembly during the trade show as well as easy to transport components between uses. In addition, the structure of the system enables the system to break down into components no more than 24"×24"×60" in size. However, it is to be understood that the full scope of the invention in not limited by these weight or dimensional values.

Figure 1:
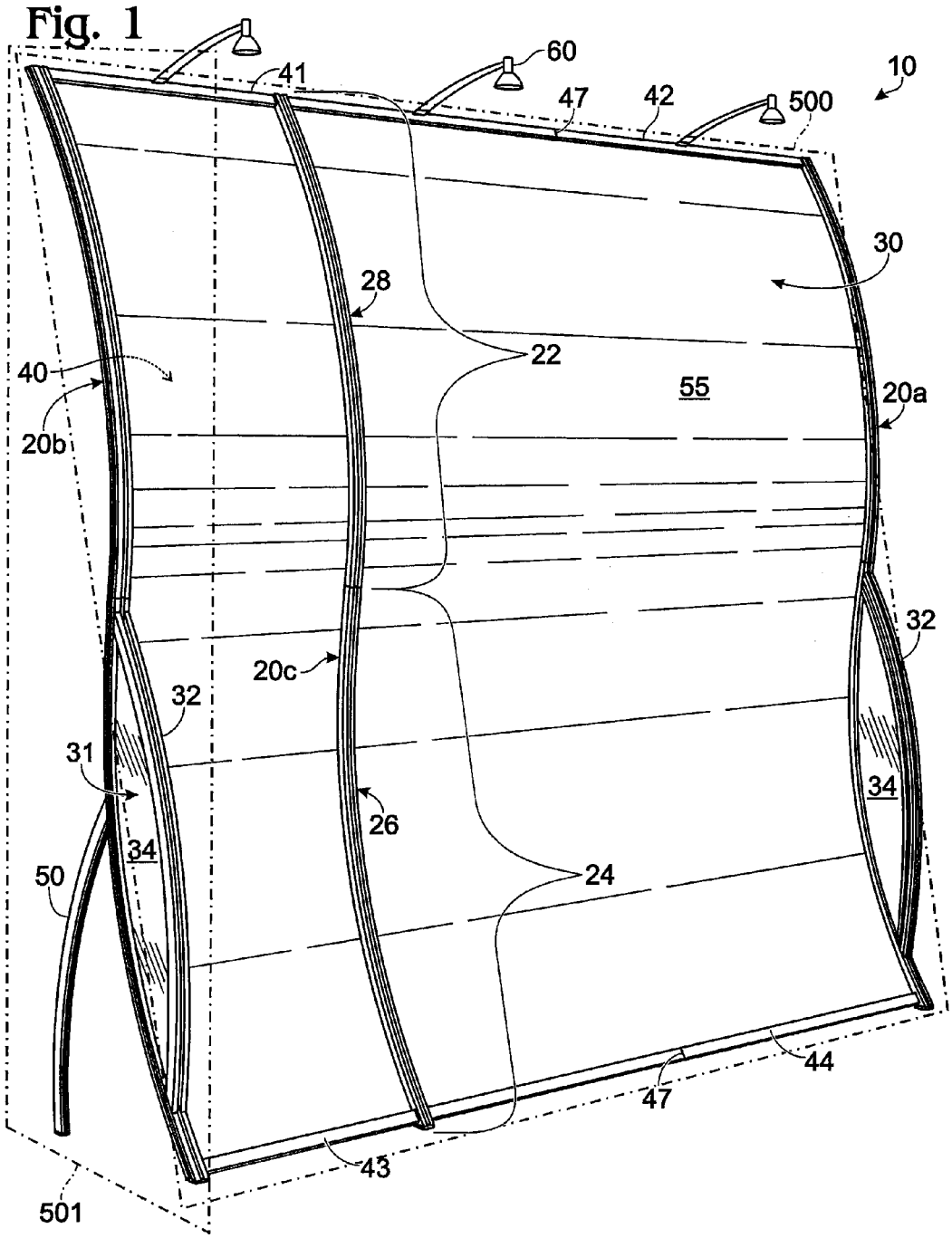
FIG. 1 is a perspective of a first embodiment of a display system according to the invention showing the front and left sides thereof, as well as a first and second plane defined by the display system.
Figure 2:
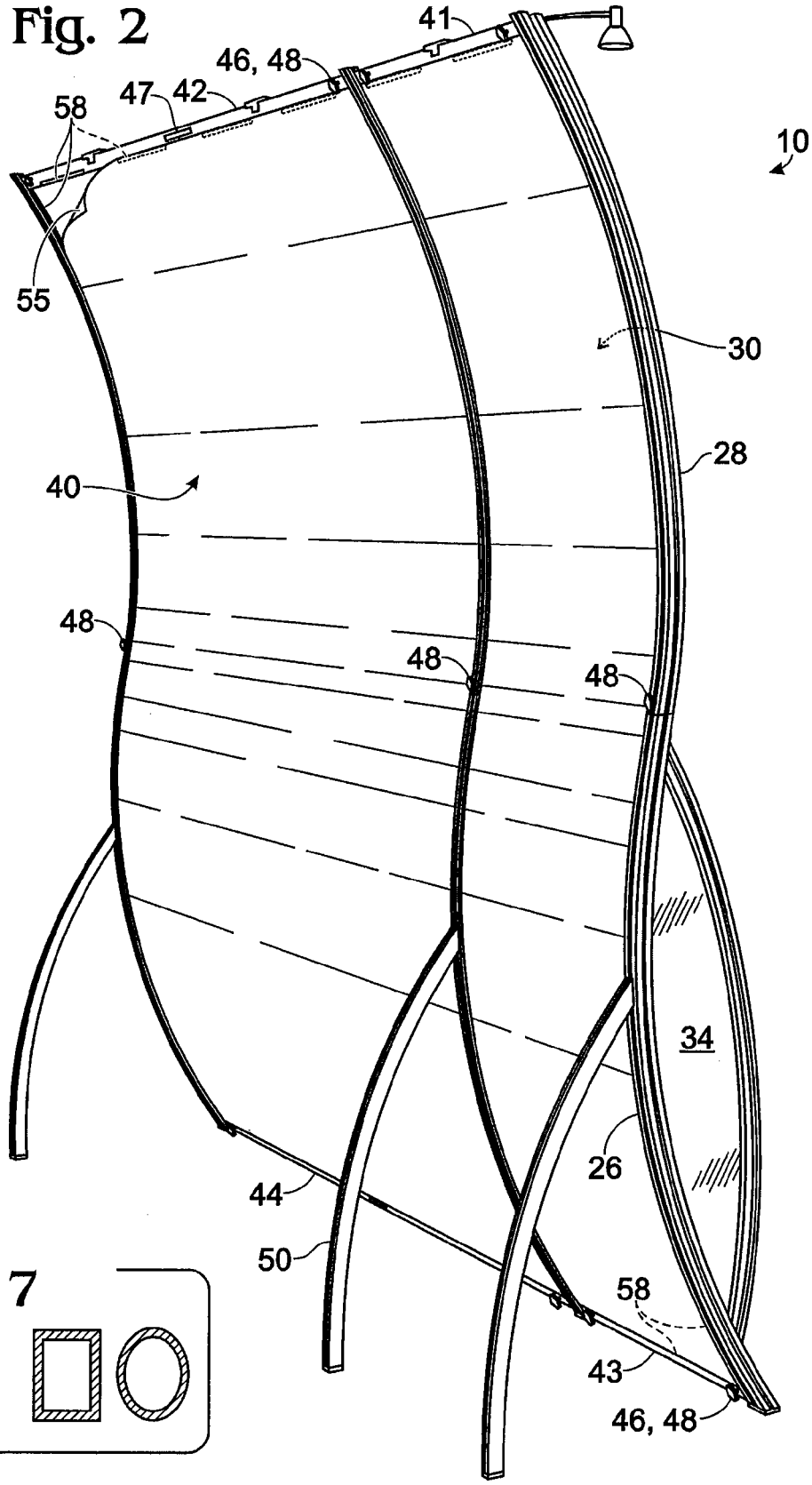
FIG. 2 is a perspective showing the rear and left sides of the embodiment of FIG. 1.

In a first exemplary embodiment, and referring to FIG. 1, the display system comprises a back wall display 10. The upper and lower lateral members, described further below, define a first plane 500. The vertical members, legs, and arcuate braces, described further below, define a second plane 501. FIG. 1 shows the front side 30 of the embodiment; FIG. 2 shows the back side 40 of the embodiment.

The back wall 10 comprises three curved, vertical members 20*a*, 20*b*, and 20*c*, one each placed at the extreme left and right side of the display area, and the third placed approximately one-third of the distance between the two outside members. The vertical members define two portions, an upper portion 28 and lower portion 26 which are connected together with releasable fasteners, for example, a threaded screw hand-tightened against a spline. Another non-limiting example of a suitable releasable fastener would be a MODUL PR53 connector, available from MODUL International, Sperberweg 4, D-41468 Neuss, Germany (and in the U.S. from Classic Exhibits, Portland, Oreg.).

In this embodiment, the lower portions are bent to form a concave arc 24 and the upper supports are bent to form a convex arc 22, as viewed from the front side 30 of the display. Arcuate stabilizing members 32 are attached to the lower portion 26 of members 20*a* and 20*b* and help create a stable, rigid frame. An infill 34 is disposed in the interior space 31 defined by arcuate stabilizing member 32 and the lower portion 26. Infill 34 is provided to create additional visual impact and preferably comprises a sheet of plastic, cardstock, or fabric.

Figure 3:
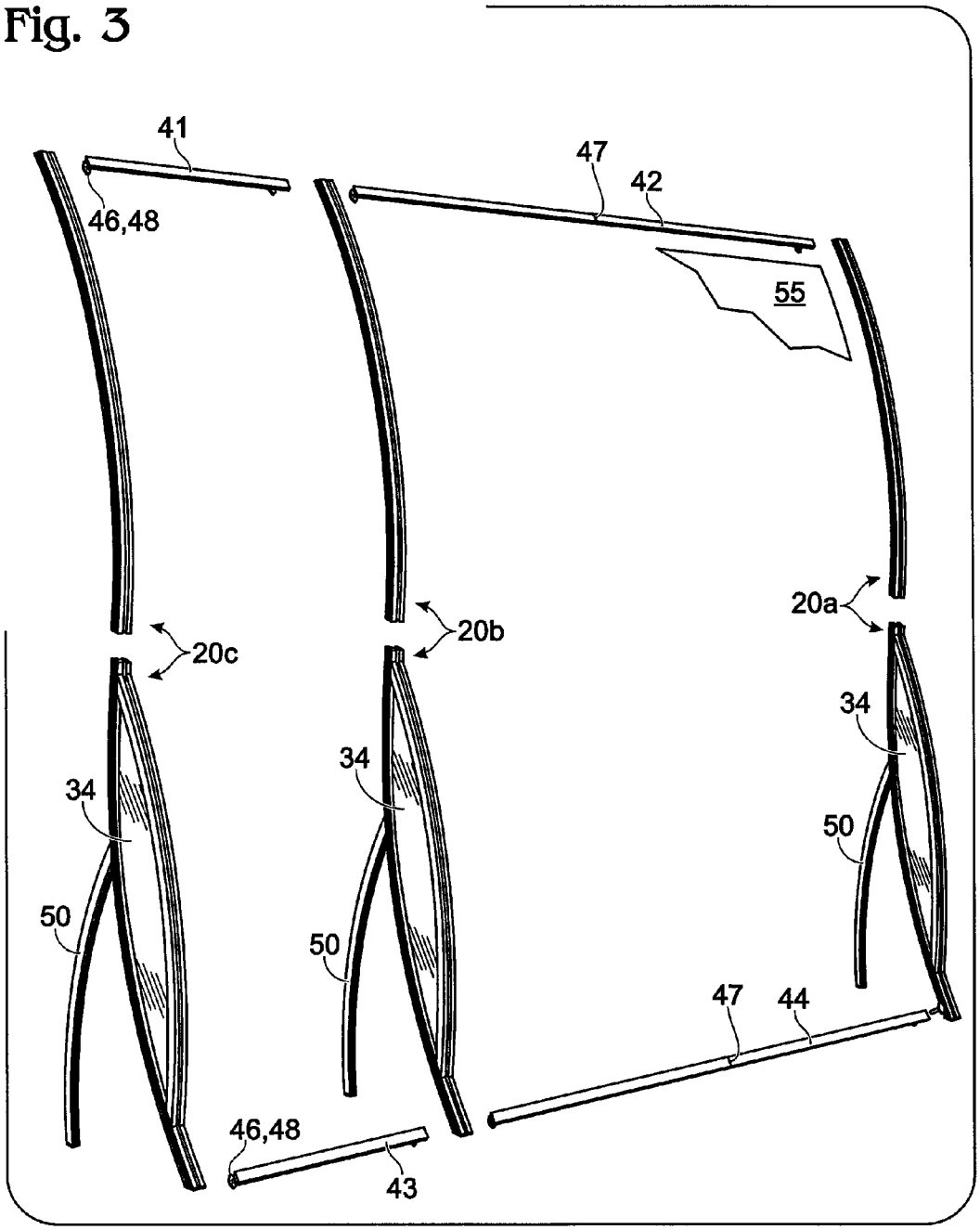
FIG. 3 is an exploded view of the framework assembly of the embodiment of FIG. 1.

Referring now to FIG. 2 and FIG. 3, the vertical members 20*a*, 20*b*, and 20*c*, are releasably connected to a top lateral member having a first portion 41 and a second portion 42, and a bottom lateral member having a first portion 43 and a second portion 44. The attachment between the vertical and horizontal members is accomplished without the need for extrinsic tools by releasable fasteners. For example, a Modul FIX 31, available from MODUL International, Sperberweg 4, D-41468 Neuss, Germany (and in the U.S. from Classic Exhibits, Portland, Oreg.) can be used as connector 46 with knobs 48 to form a hand-tightened attachment. However, other types of releasable fasteners may be used without departing from the principles of the invention.

In this embodiment, the top and bottom lateral member portions are each one-piece, and lateral member portions 42 and 44 include a hinged joint 47 in the middle to fold for easy transport. Legs 50 are attached to the back side of the lower portion of the vertical member to form a 6-point support for the display.

Referring again to FIG. 1, the display surface 55 of back wall display 10 preferably comprises a flexible, printed fabric. In this embodiment, as shown in FIG. 2, the display surface 55 is releasably attached to the back side of the vertical supports 20*a*, 20*b*, and 20*c* and horizontal lateral members 41, 42, 43 and 44 utilizing hook and loop fasteners 58. Note that FIG. 2 shows the hook and loop fasteners 58 on the upper lateral members only, however they are located on each vertical and lateral member as described above.

Additionally, commercially available lights 60 may be clamped onto the top lateral member 41 and 42. The lights are preferably attached using releasable fasteners, such as threaded clamp connections, that do not require extrinsic tools to assemble or disassemble.

Figure 4:
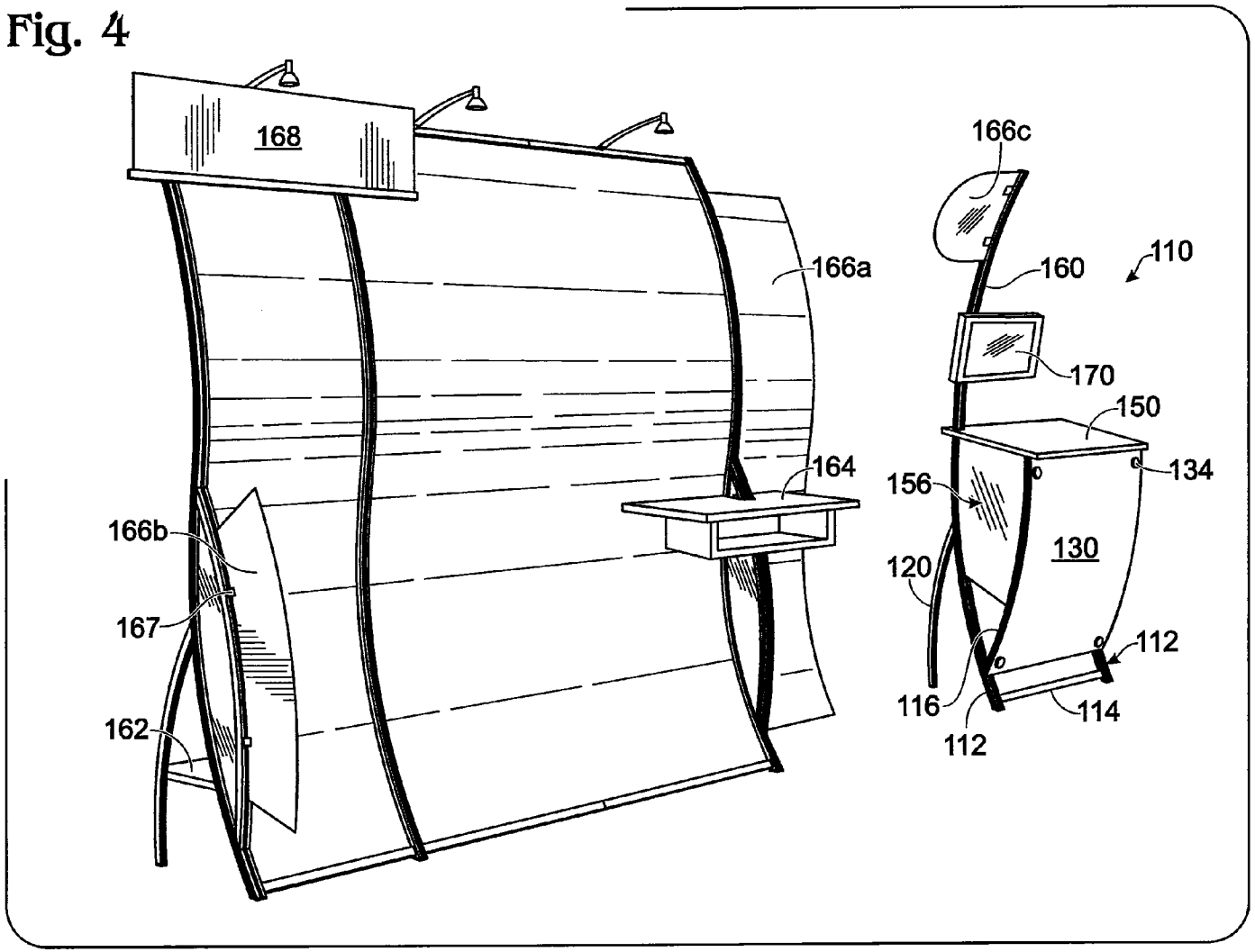
FIG. 4 is a perspective of a second embodiment of a display system according to the invention, including the back wall display of FIGS. 1 through 3, an associated workstation, a cubby, a rear shelf, additional graphic panels, and a signboard.

FIG. 4 shows a second embodiment of the display system further including a workstation 110 to be used in association with the back wall. The structure of the workstation is similar to the back wall display, and comprises a concave, arcuate back member 112, a convex, arcuate front member 116, and legs 120. Lateral member 114 releasably connects to back member 112 using, as a non-limiting example, Modul connections as described above. Front panel 130 is releasably connected to front members 116 with hand-tightened threaded connections 134 similar to that described in Example 1. Desk surface 150 is releasably connected using a friction fit or can also be attached with hand-tightened, threaded connections.

Front panel 130 of workstation 110 may preferably comprise flexible, pre-printed fabric, light gage metal, lightweight plastic, or other suitable flexible material. Side panel infill 156 may preferably comprise flexible, preprinted fabric, light gage metal, lightweight plastic, or other suitable material. Back member 112, front member 116, leg 120, and side panel infill 156 need not be disassembled for shipment. Optional upper member 160 is connected to back member 112 with releasable fasteners. As described above, Modul connectors are one example of a suitable releasable fastener, though others may be used without departing from the principles of the invention. Upper member 160 may provide mounting points for various additional features, including accent graphics 166*c* as well shelving (not shown, but similar to item 310 in FIG. 6) or video displays 170.

FIG. 4 also shows optional features that may be added to the back wall, such as rear shelf 162 and shelf/brochure holder 164. Accent graphics 166*a*, 166*b*, and 166*c* are releasably connected to the vertical frame members using clips 167. Additionally, a virtually limitless variety of signs or graphics 168 may be attached to the upper vertical member or top lateral member, again using releasable fasteners that do not require extrinsic tools.

Figure 5:
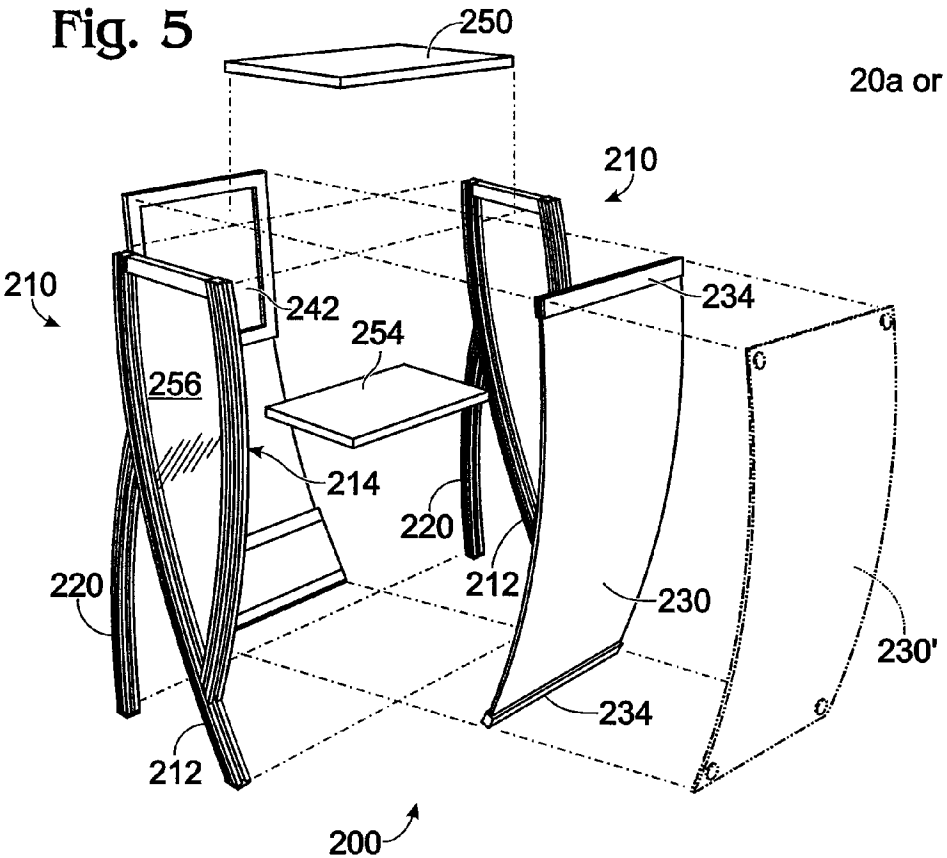
FIG. 5 is a perspective of an alternate embodiment of the workstation shown in FIG. 4, including an internal shelf and locking access door.

FIG. 5 shows another embodiment of a workstation associated with the display system. In this embodiment, workstation 200 comprises two side frames 210, each of which further comprises a concave, arcuate back member 212, a convex, arcuate front member 214, and leg 220. Front panel 230 includes lateral members 234 that are releasably connected to front members 214 with hand-tightened threaded connections, for a non-limiting example, a Modul connection may be used. Alternate front panel 230' is releasably connected using hand-tightened, threaded connections. Desk surface 250 is releasably connected using a friction fit or can also be attached with hand-tightened, threaded connections. In this embodiment, rear panel 242 includes an access door and is releasably connected to back members 212. Interior shelf 254 is releasably fastened to rear member 212 and front member 214.

Front panel 230 and alternate front panel 230' of workstation 200 may preferably comprise flexible, pre-printed fabric, light gage metal, lightweight plastic, or other suitable flexible material. Side panel infill 256 may preferably comprise flexible, preprinted fabric, light gage metal, lightweight plastic, or other suitable material. Back member 212, front member 214, leg 220, and side panel infill 256 are not disassembled for shipment.

Figure 6:
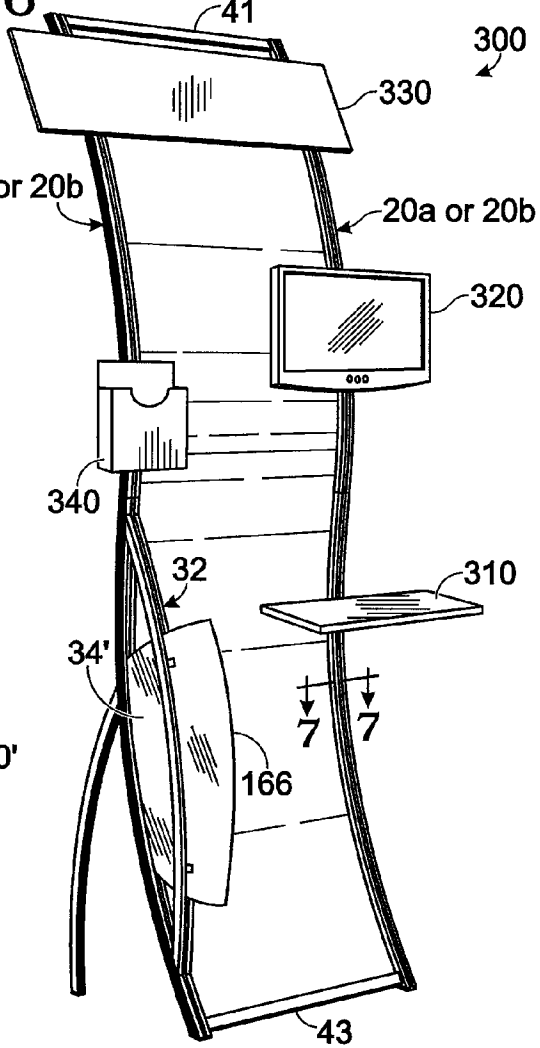
FIG. 6 is a perspective of a third embodiment of the display system according to the invention, utilizing two vertical members rather than three and showing additional features that can be releasably connected to the display system, including a sign board, a video display, a brochure holder, a writing desk, and graphic panel.

FIG. 6 shows another embodiment of the display system termed a banner display 300. Banner display 300 comprises two vertical members 20*a* or 20*b* like those of the back wall display of FIG. 1, lateral top and bottom members 41 and 43 like those of the back wall display of FIG. 1, as well as the legs, the display surface, and optionally the arcuate brace like those of the back wall display of FIG. 1. The banner display can be used as an accent piece or on its own for smaller display areas. Additional elements such as brochure holder 340, writing surface 310, video display 320, signboard 330, and other accent graphics 166 can be releasably connected to the vertical and lateral members to add more visual appeal or provide additional information on the advertised product.

While the above description contains many specific details, these should not be construed as limitations on the scope of the invention, but rather as examples of several preferred embodiments. Many variations of the display system are possible, but have been omitted from the drawings as less important to the function of the device.

Figure 7:
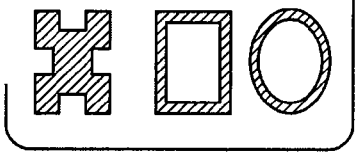
FIG. 7 is a set of cross-sectional views of three alternative shapes for the vertical support frame member within the display system.

For example, the vertical supports are preferably constructed from extruded aluminum H-shapes as shown in the examples, but could also be constructed from material with cross sections that are round, square, oval, rectangular, C- or L-shaped without departing from the principles of the invention. Examples of H-shaped, round, and rectangular cross sections are shown in FIG. 7. The display surface is shown as made of flexible, stretchable fabric that is the most common surface in the industry today, but could be replaced with other materials including paper, wood, plastic, or metal, provided that it is capable of bending to the shape of the vertical supports. The fill material between the arcuate braces and the lower supports can be transparent, translucent, or opaque and can be made of various materials and textures.

An innumerable number of shapes, including waves, concave and convex curves, rectangles, ovals, etc. can be attached to the frame members as accent graphics.

The workstation desktop is preferably square as shown, but may be round, oval, or any other shape, without departing from the principles of the invention.

The terms and expressions that have been employed in the foregoing specification are used therein as terms of description and not of limitation, and there is no intention, in the uses of such terms and expressions, to exclude equivalents of the features shown and described or portions thereof, it being recognized that the scope of the invention is defined and limited only by the claims which follow.

What is claimed is:

1. A display system, comprising:

a framework having a lower elongate lateral member, an upper elongate lateral member, and a plurality of elongate vertical members, the vertical members being adapted to connect releasably at one end to the lower lateral member and to connect releasably at the opposite end to the upper lateral member, each vertical member having a lower portion that, when the vertical member is connected to the lateral members, extends outside a first reference plane defined by the lower lateral member and the upper lateral member, and an upper portion that extends outside said first reference plane in the direction opposite the direction of extension of the lower portion, so as to support a display surface that conforms to the shape of the framework;

a plurality of legs connected to respective vertical members, the legs extending outside the first reference plane in the same direction as the direction of extension of the lower portion of the vertical members so that, when the display system is assembled, it is supported by the lower portions of said vertical members and the legs;

releasable fasteners adapted to connect the elongate vertical members to the elongate lateral members; and releasable fasteners for attaching the display surface to the lower elongate lateral member, the upper elongate lateral member, and at least two vertical elongate members for displaying information.

2. The display system of claim 1, further comprising, for at least one of the elongate vertical member, a stabilizing member connected at each end to the lower portion of said elongate vertical member and extending in the opposite direction from the lower portion thereof.

3. The display system of claim 2, wherein a sheet of material is disposed between the stabilizing member and the corresponding elongate vertical member, substantially in the second reference plane.

4. The display system of claim 2, wherein said stabilizing member lies substantially in a second reference plane defined by the corresponding elongate vertical member and stabilizing member, the second reference plane being substantially perpendicular to the first reference plane.

5. The display system of claim 4, wherein at least one leg connected to a corresponding elongate vertical member lies substantially in the second reference plane.

6. The display system of claim 1, wherein the lower portions of the elongate vertical members extend rearwardly of the first reference plane and the upper portions of the elongate vertical members extend forwardly of the first reference plane.

7. The display system of claim 6, wherein the elongate vertical members are reverse-S-shaped.

8. The display system of claim 7, wherein the elongate vertical members have an H-shaped cross section.

9. The display system of claim 7, wherein the elongate vertical members have a substantially round cross section.

10. The display system of claim 7, wherein the elongate vertical members have a rectangular cross section.

11. The display system of claim 7, further comprising a stand alone workstation constructed of arcuate side frames and legs of the same material, cross section, and radius of said S-shaped members.

12. The display system of claim 1, wherein the elongate vertical members are reverse-S-shaped.

13. The display system of claim 1, wherein the releasable connections include a means for connection without the aid of tools.

14. A method for constructing a display, comprising:

providing a lower elongate lateral member, an upper elongate lateral member, and a plurality of elongate vertical members, the vertical members being adapted to connect releasably at one end to the lower lateral member and to connect releasably at the opposite end to the upper lateral member, each vertical member having a lower portion that, when the vertical member is connected to the lateral members, extends outside a first reference plane defined by the lower lateral member and the upper lateral member, and an upper portion that extends outside said first reference plane in the direction opposite the direction of extension of the lower portion so as to support a display surface, that conforms to the shape of the framework;

connecting at least two elongate vertical members to the elongate lower member and the elongate upper member;

connecting a leg to at least two respective vertical members, the legs extending outside the first reference plane in the same direction as the direction of extension of the lower portion of the vertical members; and erecting the interconnected elongate lower member, the elongate upper member, and elongate vertical members so that the interconnected assembly is supported by the lower portions of said vertical members and the legs.

15. The method of claim 14, further comprising completing all assembly without the use of extrinsic tools.

16. The method of claim 14, further comprising attaching the display surface to the lower elongate lateral member, the upper elongate lateral member, and at least two vertical elongate members for displaying information.

17. The method of claim 16, further comprising completing all assembly without the use of extrinsic tools.

* * * * *